US012391498B2

(12) United States Patent
Kim

(10) Patent No.: US 12,391,498 B2
(45) Date of Patent: Aug. 19, 2025

(54) PAPER FEEDING APPARATUS

(71) Applicant: A4 HOUSE CO., LTD., Seoul (KR)

(72) Inventor: Hong Min Kim, Seoul (KR)

( * ) Notice: Subject to any disclaimer, the term of this patent is extended or adjusted under 35 U.S.C. 154(b) by 97 days.

(21) Appl. No.: 18/274,080

(22) PCT Filed: Nov. 1, 2021

(86) PCT No.: PCT/KR2021/015500
§ 371 (c)(1),
(2) Date: Jul. 25, 2023

(87) PCT Pub. No.: WO2022/169068
PCT Pub. Date: Aug. 11, 2022

(65) Prior Publication Data

US 2024/0327147 A1 Oct. 3, 2024

(30) Foreign Application Priority Data

Feb. 4, 2021 (KR) ..... 20-2021-0000369

(51) Int. Cl.
*B65H 1/20* (2006.01)
*B65H 1/14* (2006.01)
*B65H 7/02* (2006.01)

(52) U.S. Cl.
CPC ..... *B65H 1/20* (2013.01); *B65H 1/14* (2013.01); *B65H 7/02* (2013.01); *B65H 2403/30* (2013.01);
(Continued)

(58) Field of Classification Search
CPC ... B65H 1/14; B65H 1/18; B65H 1/20; B65H 7/02; B65H 7/04; B65H 2402/45;
(Continued)

(56) References Cited

U.S. PATENT DOCUMENTS 5,145,167 A * 9/1992 McGraw ..... B65H 29/40 271/306
5,518,230 A * 5/1996 Scarlata ..... B65H 29/40 271/215

(Continued)

FOREIGN PATENT DOCUMENTS

JP 2005-112549 A 4/2005
JP 2007-101966 A 4/2007

(Continued)

*Primary Examiner* — Prasad V Gokhale
(74) *Attorney, Agent, or Firm* — KORUS Patent, LLC; Seong Il Jeong

(57) ABSTRACT

The present invention relates to a paper feeding apparatus. The paper feeding apparatus includes: a main body configured such that a paper discharge outlet, a space, and a door are formed therein; a plurality of guide rails formed inside the main body in vertical directions; a plurality of guide rods formed inside the main body in vertical directions; a paper support plate formed in a plate shape so that paper is stacked and supported thereon, and configured such that a plurality of bushings, insertion grooves, and a multi-stage screw are formed in connection with the paper support plate; a power unit including a motor provided with a driving pulley, a driven pulley, and a chain configured to connect the driving pulley and the driven pulley; and a sensor configured to measure the weight of paper, and a controller configured to control the driving of the power unit.

2 Claims, 5 Drawing Sheets

(52) U.S. Cl.
CPC ..... *B65H 2403/52* (2013.01); *B65H 2405/15* (2013.01); *B65H 2511/15* (2013.01)

(58) Field of Classification Search
CPC ..... B65H 2402/52; B65H 2402/53; B65H 2403/30; B65H 2403/52; B65H 2405/15; B65H 2405/353; B65H 2511/15
See application file for complete search history.

(56) References Cited

U.S. PATENT DOCUMENTS

| | | | | |
|---|---|---|---|---|
| 2012/0098660 | A1* | 4/2012 | Hoover ..... | B65H 31/10 33/701 |
| 2015/0115523 | A1* | 4/2015 | Yamaguchi ..... | B65H 1/14 271/162 |

FOREIGN PATENT DOCUMENTS

| | | | |
|---|---|---|---|
| JP | 2013-184755 | A | 9/2013 |
| KR | 10-1223959 | B1 | 1/2013 |
| KR | 20-0494202 | Y1 | 8/2021 |

* cited by examiner

PAPER FEEDING APPARATUS

TECHNICAL FIELD

The present invention relates to a paper feeding apparatus, and more particularly, to a paper feeding apparatus that, in a state in which a large amount of paper is stacked, automatically senses a paper shortage state and then informs an external paper supplier of the paper shortage state so that the paper supplier can replenish the paper feeding apparatus with paper without a need for a user to separately determine the amount of remaining paper.

BACKGROUND ART

Paper for offices (e.g., A4 paper) widely used in companies or government offices is packaged in units of hundreds of sheets, and the paper packaged in small size as described above is boxed again in bundle forms and fed to consumers. When using the packaged paper, the consumers dismantle the box packaging, peel off packaging paper, and then fill a printer, a copier, or an all-in-one printer with the paper.

When using paper, consumers generally do not keep track of the amount of remaining paper after purchasing paper on a per-box package or small-sized package basis. Accordingly, when a printer, a copier, or an all-in-one printer runs out of paper, the consumers first look for small-packaged or box-packaged paper to fill paper. If there is no paper or there is not sufficient paper left at that time, consumers will purchase or order paper from an online or offline store. Users always purchase or order paper on a per-box basis in order to avoid a paper shortage.

Accordingly, there is a demand for a scheme capable of, in the feeding of paper for offices, reducing the above-described costs or waste of human and material resources attributable to the double packaging composed of small-sized packaging of hundreds of sheets using packaging paper and bundled box packaging and also reducing the above-described inconvenience in which consumers keep track of the amount of remaining paper and then order or purchase paper.

DISCLOSURE

Technical Problem

The present invention has been conceived to overcome the problems of the prior art, and an object of the present invention is to provide a convenient paper feeding apparatus that can reduce the costs and waste of resources attributable to conventional double packaging composed of small-sized unit packaging and box packaging in the feed of paper for offices and prevent a consumer from having to keep track of the amount of remaining paper.

Technical Solution

The above-described object of the present invention is accomplished by a paper feeding apparatus including: a main body configured such that a paper discharge outlet is formed in an upper portion of a front side thereof, a space is formed therein, and a door configured to be selectively opened and closed is formed in the front side thereof, a paper support plate formed in a plate shape so that paper is stacked and supported thereon; an elevation unit installed inside the main body, and configured to selectively elevate and lower the paper support plate; a power unit mounted in a lower part of the main body, and configured to move the paper support plate; a sensor configured to measure a weight of the paper stacked on the paper support plate; and a controller configured to control the driving of the power unit in conjunction with the sensor; wherein the controller, when the sensor detects a change in the weight of the stacked paper, elevates the paper support plate in association with a moving distance calculated according to a reduction in weight by driving the motor to extend the multi-stage screw.

The paper feeding apparatus further includes a communication unit integrated with or provided to correspond to the paper feeding apparatus and configured to transmit a paper replenishment request signal when the paper feeding apparatus senses a paper shortage state and transmit a paper replenishment completion signal when the paper feeding apparatus senses a paper replenishment completion state.

The multi-stage screw includes: a first-stage screw connected to a driven pulley, and provided with a thread that is formed on an outer circumferential surface thereof; a second-stage screw screwed to the first-stage screw, and provided with a thread that is formed on an outer circumferential surface thereof; a third-stage screw screwed to the second-stage screw, and provided with a thread that is formed on an outer circumferential surface thereof; and a screw housing screwed to an outside of the third-stage screw, and provided with a top end that is fixed to the paper support plate.

The controller further includes a height detection unit configured to detect whether the paper support plate reaches a desirably set remaining amount height; and the controller generates a paper shortage signal when the height detection unit detects a situation in which the paper support plate reaches the set remaining amount height. The controller transmits a paper shortage signal to the communication unit when the height detection unit detects a situation in which the paper support plate reaches the set remaining amount height.

The paper support plate is configured such that a plurality of bushings to be fitted around the guide rods are formed and insertion grooves into which the guide rails are coupled are formed therein.

The power unit includes a motor mounted in a lower part of the main body and provided with a driving pulley, a driven pulley formed at a lower end of the multi-stage screw, and a chain configured to connect the driving pulley and the driven pulley.

The controller further includes a height detection unit configured to detect whether the paper support plate reaches a set remaining amount height; and the controller stops the operation of the motor when the height detection unit detects a situation in which the paper support plate reaches the set remaining amount height.

The elevation unit includes: a plurality of guide rails formed inside the main body in a vertical direction; a plurality of guide rods formed inside the main body in a vertical direction, and arranged in parallel with the guide rails; and a multi-stage screw formed under the paper support plate.

Advantageous Effects

According to the present invention, there is provided a paper feeding apparatus of a new concept that can automatically determine the amount of remaining paper and feed paper, so that there can be provided the effects of reducing the costs and waste of resources attributable to conventional small-sized unit packaging and box packaging and providing convenience to consumers.

In addition, there is an effect of contributing to the prevention of environmental contamination because there is no need for separate manufacturing and waste disposal of small-sized unit packaging paper for the packaging of hundreds of sheets of paper and box packaging paper for box packaging.

MODE FOR INVENTION

The amount of remaining stacked paper for offices is automatically determined and then paper is fed, so that the convenience of a consumer can be improved in the management of paper for offices and the costs and waste of resources attributable to conventional small-sized unit packaging and box packaging can be reduced.

Embodiments will be described in detail below with reference to the accompanying drawings. However, since various modifications may be made to the embodiments, the scope of rights is not limited or restricted by these embodiments. It should be understood that all modifications, equivalents and substitutes to the embodiments are included within the scope of rights.

Specific structural or functional descriptions of the embodiments are disclosed for illustrative purposes only, and may be modified and implemented in various forms. Accordingly, the embodiments are not limited to specific disclosed forms, and the scope of the present specification includes modifications, equivalents, or substitutes included in the technical spirit.

Although terms such as first or second may be used to describe various components, such terms should only be construed for the purpose of distinguishing one component from another. For example, a first element may be termed a second element, and similarly, a second element may be termed a first element.

Figure 1:
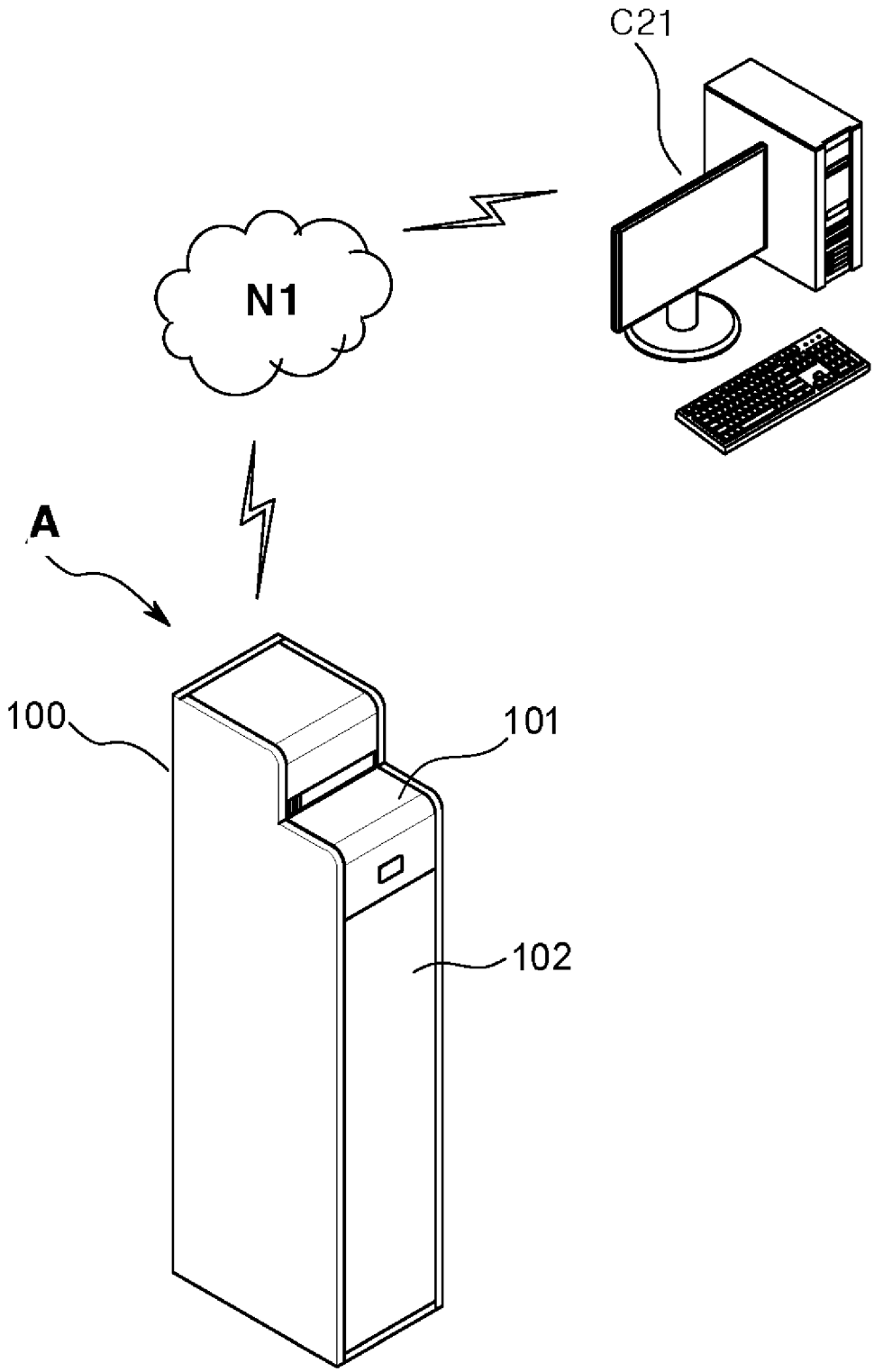
FIG. 1 is a perspective view showing a paper feeding apparatus according to the present invention.
Figure 2:
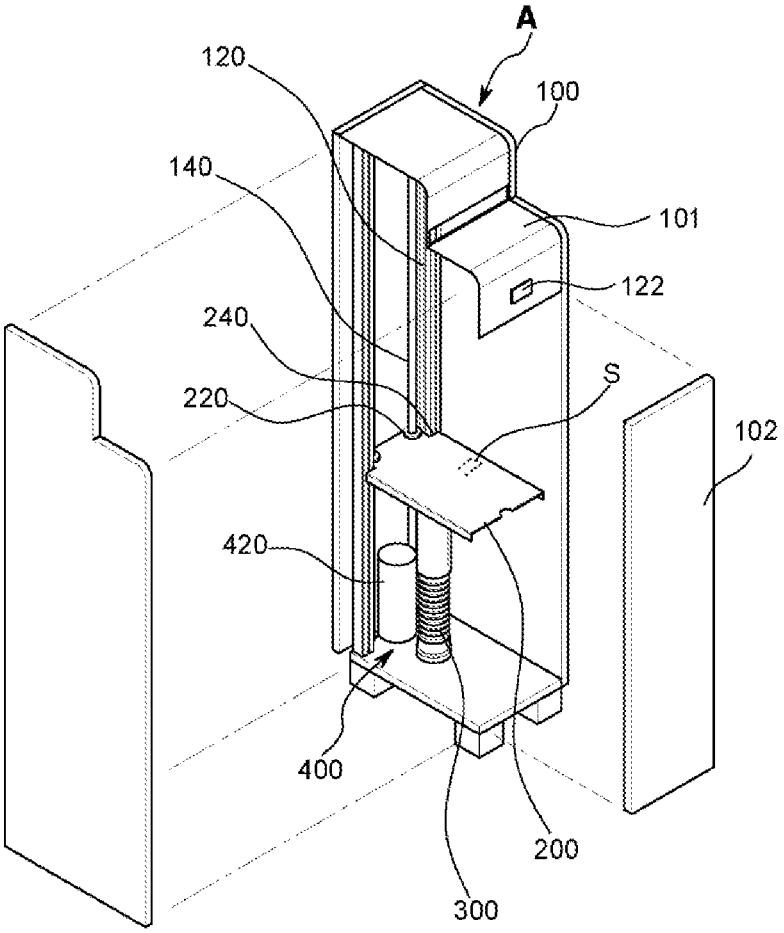
FIG. 2 is an exploded perspective view showing the paper feeding apparatus according to the present invention.
Figure 3:
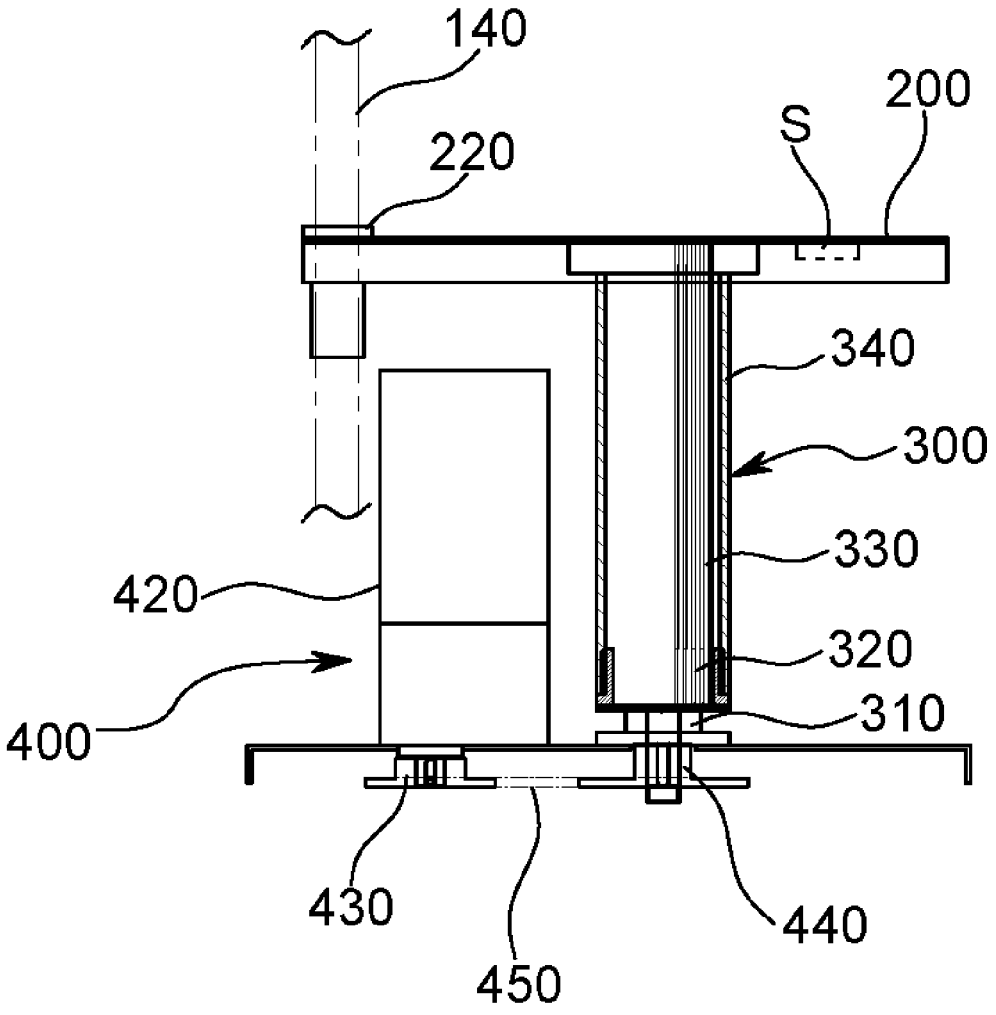
FIG. 3 is a view showing the 'power unit' of the paper feeding apparatus according to the present invention.
Figure 4A:
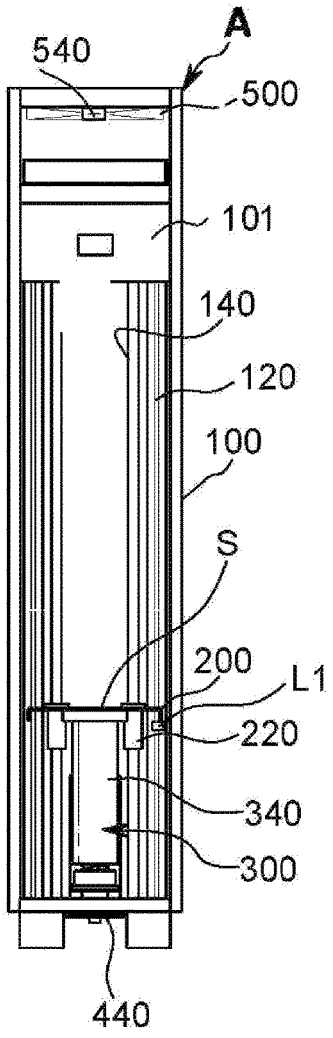
FIGS. 4A-4C are front views showing the elevation operation of the 'paper support plate' of the paper feeding apparatus according to the present invention.
Figure 4B:
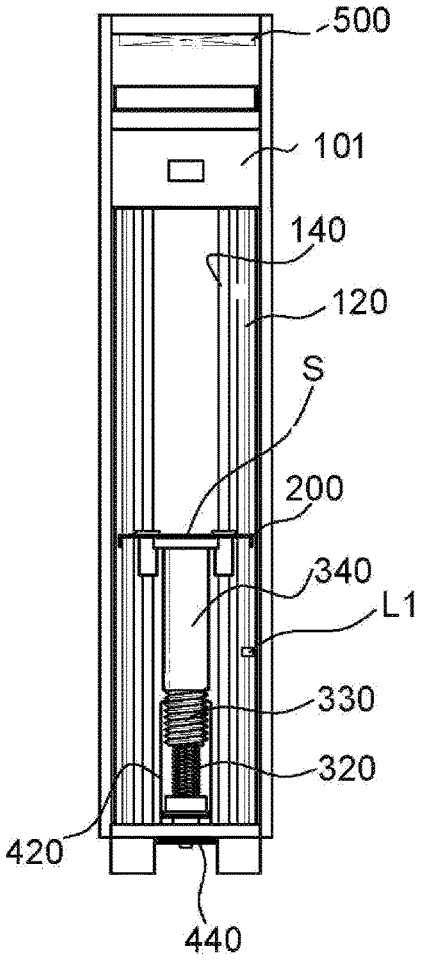
Figure 4C:
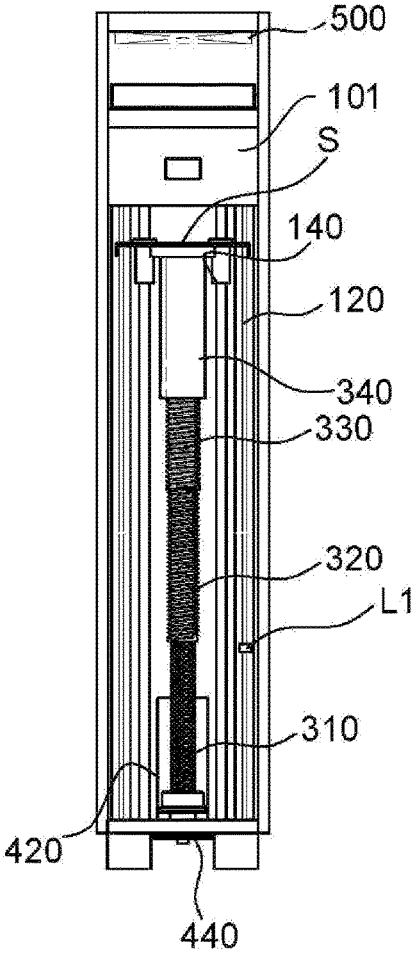
Figure 5:
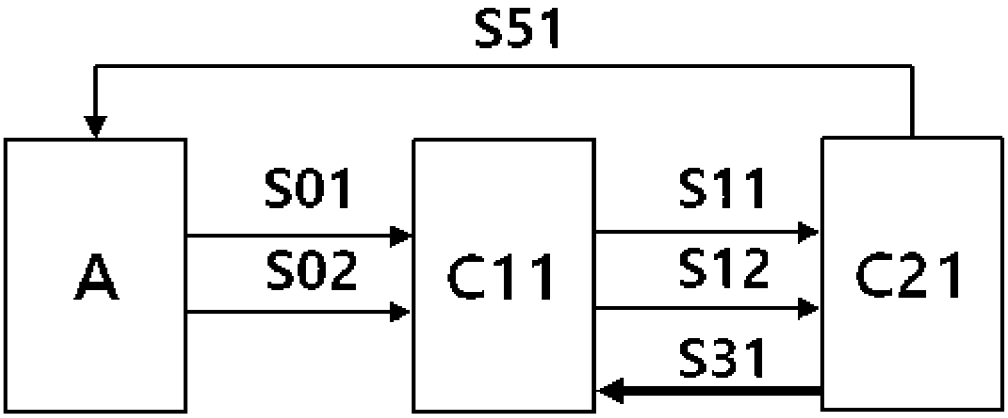
FIG. 5 is a view showing a paper feeding system according to an embodiment of the present invention.

Among the accompanying drawings, FIG. 1 is a perspective view showing a paper feeding apparatus according to the present invention, FIG. 2 is an exploded perspective view showing the paper feeding apparatus according to the present invention, FIG. 3 is a view showing the 'power unit' of the paper feeding apparatus according to the present invention FIGS. 4A-4C are front views showing the elevation operation of the 'paper support plate' of the paper feeding apparatus according to the present invention, and FIG. 5 is a view showing a paper feeding system according to an embodiment of the present invention.

As shown in FIGS. 1 to 5, a paper feeding apparatus A according to the present invention is configured to include: a main body 100 configured such that a paper discharge outlet 101 is formed in the upper portion of the front side thereof, a space is formed therein, and a door 102 configured to be selectively opened and closed is formed in the front side thereof,

- a plurality of guide rails 120 formed inside the main body 100 in vertical directions;
- a plurality of guide rods 140 formed inside the main body 100 in vertical directions, and arranged in parallel with the guide rails 120;
- a paper support plate 200 formed in a plate shape so that paper is stacked and supported thereon, and configured such that a plurality of bushings 220 fitted around the guide rods 140 are formed, insertion grooves 240 into which the guide rails 120 are coupled are formed, and a multi-stage screw 300 is formed thereunder;
- a power unit 400 including a motor 420 mounted in the lower part of the main body 100 and provided with a driving pulley 430, a driven pulley 440 formed at the lower end of the multi-stage screw 300, and a chain 450 configured to connect the driving pulley 430 and the driven pulley 440; and
- a sensor S mounted on the paper support plate 200 and configured to measure the weight of paper, and a controller 500 connected to the sensor S and configured to control the driving of the power unit 400.

When the sensor S detects a change in the weight of the stacked paper, the controller 500 elevates the paper support plate 200 in association with the moving distance calculated according to the reduction in the weight by driving the motor 420 to extend the multi-stage screw 300. Accordingly, the paper support plate 200 selectively moves up and down while supporting the paper, so that a predetermined amount of paper is partially drawn out through the paper discharge outlet 101 when it is necessary to replenish a copier, a printer, and an all-in-one printer, and thus a user may conveniently remove and use paper.

The elevation unit includes: the plurality of guide rails 120 formed inside the main body 100 in a vertical direction; the plurality of guide rods 140 formed inside the main body 100 in a vertical direction and arranged in parallel with the guide rails 120; and the multi-stage screw 300 formed under the paper support plate 200 formed in a plate shape so that paper is stacked and supported thereon.

The main body 100 is formed in a rectangular parallelepiped shape having an internal space so that a large amount of paper can be stacked and stored in a vertical direction, and the paper discharge outlet 101 is formed in the upper portion of the front surface so that the user can open the paper discharge outlet 101 and take out the inner paper. Meanwhile, a locking device 122 may be additionally formed in the paper discharge outlet 101 so that the use of the paper can be managed.

The door 102 is hingedly coupled to the front of the main body 100 to be selectively opened and closed so that paper can be filled therein.

A heating device (not shown) configured to prevent moisture may be provided inside the main body 100. The heating device can prevent paper from being deformed due to moisture.

The power unit 400 is connected to the multi-stage screw 300, and causes the operation of selectively extending and reducing the length of the multi-stage screw 300.

The power unit 400 includes the motor 420 mounted in the lower part of the main body 100 and provided with the driving pulley 430, the driven pulley 440 formed at the lower end of the multi-stage screw 300, and the chain 450 configured to connect the driving pulley 430 and the driven pulley 440.

The multi-stage screw 300 includes a first-stage screw 310 connected to the driven pulley 440 and provided with a thread that is formed on the outer circumferential surface thereof, a second-stage screw 320 screwed to the first-stage screw 310 and provided with a thread that is formed on the outer circumferential surface thereof, a third-stage screw 330 screwed to the second-stage screw 320 and provided with a thread that is formed on the outer circumferential surface thereof, and a screw housing 340 screwed to the outside of the third-stage screw 330 and provided with a top end that is fixed to the paper support plate 200. Accordingly, the first-stage screw 310 is coupled to the shaft of the driven pulley 440, and the driven pulley 440 is connected to the driven pulley 430 by the chain 450.

Thereafter, when the motor 420 is driven to rotate, the driven pulley 440 connected by the chain 450 is rotated in conjunction with the rotation of the main pulley 430, and the first-stage screw 310 connected to the driven pulley 440 is rotated clockwise or counterclockwise.

When the motor 420 of the power unit 400 is rotated in response to a drive signal from the controller 500, the second-stage screw 320 is raised when the first-stage screw 310 is rotated clockwise. At the time at which the raising of the second-stage screw 320 ends, the third-stage screw 330 is rotated together with the first-stage screw 310 and is raised. Accordingly, since the paper support plate 200 is elevated by the raising of the second-stage screw 320 and the third-stage screw 330, paper may be moved upward.

The paper support plate 200 may move stably in a state of being coupled to the guide rails 120 and guide rods 140 to prevent shaking during an elevation operation.

The guide rails 120 are installed symmetrically and vertically on both sides of the inner side of the main body 100, and the insertion recesses 240 into which the guide rails 120 are inserted are formed at both corners of the paper support plate 200.

The guide rods 140 are disposed in vertical directions parallel to the guide rails 120, and are coupled through the paper support plate 200.

The paper support plate 200 is provided with the bushings 220 so that the guide rods 140 penetrate and slide stably during an elevation operation. The bushings 220 are each formed in a cylindrical shape having upper and lower openings.

Furthermore, an end of the paper is supported by the guide rails 120 and the guide rails 120 serve as protective guards, so that damage to the paper can be reduced by reducing the frictional force between contact surfaces.

Meanwhile, when the amount of paper loaded on the paper support plate 200 decreases, the sensor S detects the decrease in load, and the controller 500 operates the power unit in association with the decrease in weight detected by the sensor. That is, the multi-stage screw 300 is extended by driving the motor 420, and thus the paper support plate 200 is moved upward in association with the moving distance calculated based on the decrease in weight. Paper has a predetermined weight depending on itself. The number of pages of paper discharged may be calculated through the decrease in the weight of paper. Therefore, the number of pages of paper discharged is calculated by the reduced weight, the height of the paper discharged, i.e., the moving distance, is calculated through the calculated number of pages, and the paper support plate 200 is elevated in association with the moving distance according to the reduction in weight.

Furthermore, the controller 500 further includes a height detection unit 540 configured to detect whether the paper support plate 200 reaches a desirably set remaining amount height. The controller 500 generates a paper shortage signal when the height detection unit 540 detects a situation in which the paper support plate 200 reaches the set remaining amount height. The controller 500 transmits the paper shortage signal to a communication unit C11 when the height detection unit 540 detects a situation in which the paper support plate 200 reaches the set remaining amount height.

The communication unit C11 is integrated with or provided to correspond to the paper feeding apparatus, and receives a paper shortage signal from the controller when the paper feeding apparatus senses a paper shortage state.

When the amount of paper loaded on the paper support plate 200 decreases, the sensor S detects the decrease in load. Furthermore, when the height detection sensor 540 of the controller 500 detects a situation in which the paper support plate 200 reaches the set remaining amount height in association with the decrease in weight detected by the sensor, the controller 500 generates a paper shortage signal, the controller 500 transmits the generated paper shortage signal to the communication unit C11, and the communication unit C11 informs the paper feeding terminal C21 of the paper shortage state over the communication network so that the paper feeding apparatus 10 can be replenished with paper.

The communication unit C11 is connected to the paper feeding terminal C21 over a communication network.

The communication network is a network connected for the purpose of enabling communication between terminal users. The communication network is connected to one or more terminals, links, terminal nodes, network switches, exchanges, and/or nodes, and/or the like, and enables electrical communication. The communication network includes wired and wireless communication networks such as 3G, 4G, LTE, Bluetooth, Wi-Fi, ZigBee, NFC, RFID, Ethernet, ISDN, NGN, NPL network, VPN, MAN, switch, router, overlay, Epanet, BINET, Internet, intranet, local area network (LAN), wide area networks (WAN), storage area networks (SAN), cell, and/or satellite networks, and/or combinations thereof, but are not limited thereto.

A short-range communication module (not shown) may be provided between the communication unit C11 and the paper feeding apparatus A to provide notification of a result from the paper feeding apparatus A to the communication unit C11 when a paper replenishment request state or a paper replenishment completion state is sensed. The short-distance communication method used herein may be, e.g., Bluetooth, ZigBee, VPN, or Wi-Fi, but is not limited thereto.

The operation process of the present invention will be described with reference to FIGS. 4A-4C and 5 as follows:

As shown in FIG. 4A, paper is completely filled. In the process of filling stacked paper, the paper support plate 200 continues to be lowered depending on the reverse rotation of the multi-stage screw 300 by the operation of the motor 420.

The operation of the motor 420 is stopped until the weight of the paper support plate 200 is measured and reaches an appropriate weight, and paper is filled. Meanwhile, a height detection unit L1 may be further formed in the lower part of the inside of the main body 100. The controller 500 stops the operation of the motor 420 when the height detection unit L1 detects a situation in which the paper support plate 200 reaches a desirably set remaining amount height, thereby preventing the paper support plate 200 from being lowered below the set remaining amount height.

As shown in FIG. 4B, when a predetermined amount of paper is removed and thus a small amount of paper is exhausted, the motor 420 is operated in response to the detection of a change in weight by the sensor S and an operation signal from the controller 500, and thus the multi-stage screw 300 is rotated, thereby causing the paper support plate 200 to be raised. Since the number of pages of paper discharged is calculated by the reduced weight, the height of the paper discharged is calculated to calculate the moving distance, and the paper support plate 200 is raised by the calculated moving distance. When the paper support plate 200 is raised by the moving distance, the operation of the motor 420 is stopped. Accordingly, when a predetermined amount of paper is withdrawn, the paper support plate is raised by the amount of change in weight so that the paper is always placed in the paper discharge outlet 101 and is ready to be withdrawn at all times.

The controller 500 further includes a height detection unit 540 configured to detect whether the paper support plate 200 reaches a desirably set remaining amount height. As shown in FIG. 4C, when the amount of paper loaded on the paper support plate 200 decreases, the sensor S detects the decrease in load. Furthermore, when the height detection sensor 540 of the controller 500 detects a situation in which the paper support plate 200 reaches the set remaining amount height in association with the decrease in weight detected by the sensor S, the controller 500 generates a paper shortage signal. Meanwhile, the controller 500 informs the paper feeding terminal C21 of the paper shortage signal over an external communication network so that the paper feeding apparatus 10 can be replenished with paper.

Referring to FIG. 5, the controller 500 of a paper feeding apparatus A according to an embodiment of the present invention senses a shortage of stacked paper and the completion of paper replenishment through the height detection unit 540.

When a paper shortage state is sensed in step S01, the communication unit C11 transmits a paper replenishment request signal S11 to the first server C21 over the communication network N1.

When a company that rents, provides, or manages the paper feeding apparatus A where the first server C21 is located checks the paper replenishment request signal S11 through the first server C21, the company checks information about the paper feeding apparatus A, and then feeds paper offline in step S51. Furthermore, when a paper replenishment completion state is sensed by the paper feeding apparatus A in step S02 in a state in which the paper feeding apparatus A has been replenished with paper, the communication unit C11 transmits a paper replenishment completion signal to the first server C21 through the communication network N1 depending on the detection in step S12.

When the replenishment of paper is completed by a paper supplier and the paper feeding apparatus A senses a paper replenishment completion state, the communication unit C11 transmits a paper replenishment completion signal S12 to the first server C21, so that the first server C21 side can be notified that paper replenishment is completed in the corresponding paper feeding apparatus A.

A short-range communication module (not shown) may be provided between the communication unit C11 and the paper feeding apparatus A to provide notification of a result from the paper feeding apparatus A to the communication unit C11 when a paper replenishment request state or a paper replenishment completion state is sensed. The short-distance communication method used herein may be, e.g., Bluetooth, ZigBee, VPN, or Wi-Fi, but is not limited thereto.

Meanwhile, when receiving the paper replenishment request signal S11, the first server C21 may transmit a paper payment request signal S31 to the communication unit C11. When the paper payment request signal S31 is transmitted, a payment-related window on a web browser may pop up on the communication unit C11 or a separate payment-related program may be executed. When payment is completed by the manager of the communication unit C11, a payment completion state may be checked in real time on the first server C21. When the manager of the first server C21 becomes aware that payment has been completed by checking paper payment-related information checked on the first server C21 after the payment by the manager of the communication unit C11, paper is finally fed offline by the manager of the first server C21 in step S51. The manager of the communication unit C11 may make a payment using CMS automatic transfer as a default, but a payment method is not limited thereto.

The present invention is not limited by the above-described embodiments and the accompanying drawings. Various modifications and applications not illustrated may be made within the scope of the technical spirit of the present invention, and the substitution of components and changes to other equivalent embodiments may also be made. Therefore, such modifications and applications related to the features of the present invention should be construed as being included within the scope of the present invention.

The invention claimed is:

1. A paper feeding apparatus comprising:

a main body configured such that a paper discharge outlet is formed in an upper portion of a front side thereof, a space is formed therein, and a door configured to be selectively opened and closed is formed in the front side thereof;

a paper support plate formed in a plate shape so that paper is stacked and supported thereon;

an elevation unit installed inside the main body, and configured to selectively elevate and lower the paper support plate;

a power unit mounted in a lower part of the main body, and configured to move the paper support plate;

a sensor configured to measure a weight of the paper stacked on the paper support plate; and a controller configured to control driving of the power unit in conjunction with the sensor;

wherein the controller:

when the sensor detects a change in weight of the stacked paper, elevates the paper support plate in association with a moving distance calculated according to a reduction in weight by driving the motor to extend a multi-stage screw; and further includes a communication unit configured to transmit a paper replenishment request signal when the paper feeding apparatus senses a paper shortage state and transmit a paper replenishment completion signal when the paper feeding apparatus senses a paper replenishment completion state;

wherein the controller further includes a first height detection unit configured to detect whether the paper support plate reaches a first set remaining amount height; and the controller generates a paper shortage signal when the first height detection unit detects a situation in which the paper support plate reaches the first set remaining amount height;

wherein the elevation unit includes: a plurality of guide rails formed inside the main body in a vertical direction; a plurality of guide rods formed inside the main body in a vertical direction, and arranged in parallel with the guide rails; and a multi-stage screw formed under the paper support plate;

wherein the paper support plate is configured such that a plurality of bushings to be fitted around the guide rods are formed and insertion grooves into which the guide rails are coupled are formed therein;

wherein the power unit includes a motor mounted in a lower part of the main body and provided with a driving pulley, a driven pulley formed at a lower end of the multi-stage screw, and a chain configured to connect the driving pulley and the driven pulley; and wherein the multi-stage screw includes: a first-stage screw connected to a driven pulley, and provided with a thread that is formed on an outer circumferential surface thereof; a second-stage screw screwed to the first-stage screw, and provided with a thread that is formed on an outer circumferential surface thereof; a third-stage screw screwed to the second-stage screw, and provided with a thread that is formed on an outer circumferential surface thereof; and a screw housing screwed to an outside of the third-stage screw, and provided with a top end that is fixed to the paper support plate.

2. The paper feeding apparatus of claim 1, wherein:

the controller further includes a second height detection unit configured to detect whether the paper support plate reaches a second set remaining amount height; and the controller stops an operation of the motor when the second height detection unit detects a situation in which the paper support plate reaches the second set remaining amount height, thereby preventing the paper support plate from being lowered below the second set remaining amount height.

* * * * *